US008349776B2

(12) United States Patent
Van Houten et al.

(10) Patent No.: US 8,349,776 B2
(45) Date of Patent: Jan. 8, 2013

(54) TRUNK PISTON ENGINE LUBRICATING OIL COMPOSITIONS

(75) Inventors: Wilhelmus Petrus Antonie Van Houten, Prinsenbeek (NL); Jeffrey James Toman, Oakland, CA (US)

(73) Assignees: Chevron Oronite Company LLC, San Ramon, CA (US); Chevron Oronite Technology B.V., Rotterdam (NL)

( * ) Notice: Subject to any disclaimer, the term of this patent is extended or adjusted under 35 U.S.C. 154(b) by 252 days.

(21) Appl. No.: 12/586,866

(22) Filed: Sep. 29, 2009

(65) Prior Publication Data

US 2011/0077179 A1 Mar. 31, 2011

(51) Int. Cl.
*C10M 169/04* (2006.01)
*C10M 133/56* (2006.01)
*C10L 1/22* (2006.01)

(52) U.S. Cl. ..... 508/287; 508/291; 508/228

(58) Field of Classification Search ..... 508/287, 508/228, 291
See application file for complete search history.

(56) References Cited

U.S. PATENT DOCUMENTS

| | | | | |
|---|---|---|---|---|
| 4,943,672 | A | 7/1990 | Hamner et al. | |
| 5,059,299 | A | 10/1991 | Cody et al. | |
| 5,558,802 | A | 9/1996 | Dowling | |
| 5,733,839 | A | 3/1998 | Espinoza et al. | |
| 6,372,696 | B1 | 4/2002 | Tipton | |
| 7,018,525 | B2 | 3/2006 | Miller et al. | |
| RE39,073 | E | 4/2006 | Herbolzheimer | |
| 7,083,713 | B2 | 8/2006 | Abernathy et al. | |
| 2004/0159582 | A1 | 8/2004 | Simmons et al. | |
| 2005/0077208 | A1 | 4/2005 | Miller et al. | |
| 2005/0133407 | A1 | 6/2005 | Abernathy et al. | |
| 2005/0133409 | A1 | 6/2005 | Abernathy et al. | |
| 2005/0139513 | A1 | 6/2005 | Miller | |
| 2005/0139514 | A1 | 6/2005 | Miller | |
| 2005/0227866 | A1 | 10/2005 | Berge et al. | |
| 2005/0241990 | A1 | 11/2005 | Ziemer et al. | |
| 2005/0261145 | A1 | 11/2005 | Rosenbaum et al. | |
| 2005/0261146 | A1 | 11/2005 | Rosenbaum et al. | |
| 2005/0261147 | A1 | 11/2005 | Rosenbaum et al. | |
| 2006/0016721 | A1 | 1/2006 | Miller et al. | |
| 2006/0016724 | A1 | 1/2006 | Miller et al. | |
| 2006/0076267 | A1 | 4/2006 | Miller | |
| 2006/0116298 | A1 * | 6/2006 | Chambard et al. | 508/287 |
| 2006/0201851 | A1 | 9/2006 | Rosenbaum et al. | |
| 2006/0289337 | A1 | 12/2006 | Rosenbaum et al. | |
| 2007/0027043 | A1 * | 2/2007 | Le Coent | 508/460 |
| 2009/0093387 | A1 | 4/2009 | Bertram et al. | |

FOREIGN PATENT DOCUMENTS

| | | |
|---|---|---|
| EP | 0 668 342 | 8/1999 |
| EP | 1 209 218 | 5/2002 |
| EP | 0 776 959 | 10/2004 |
| EP | 1 154 012 | 3/2008 |
| WO | WO 99/20720 | 4/1999 |
| WO | WO 99/34917 | 7/1999 |
| WO | WO 2005/107935 | 11/2005 |

OTHER PUBLICATIONS

U.S. Appl. No. 11/400,570, filed Apr. 7, 2006, Haire et al.
U.S. Appl. No. 11/535,165, Sep. 26, 2006, Ravindra et al.
U.S. Appl. No. 11/613,936, filed Dec. 20, 2006, Rosenbaum.

* cited by examiner

*Primary Examiner* — Walter D Griffin
*Assistant Examiner* — Francis C Campanell

(57) ABSTRACT

A trunk piston engine lubricating oil composition is disclosed. The trunk piston engine lubricating oil composition includes at least (a) a major amount of a basestock selected from the group consisting of at least one Group III basestock, at least one Group IV basestock and mixtures thereof; (b) at least one detergent additive; and (c) at least one dispersant additive; wherein the concentration of the at least one dispersant additive in the trunk piston engine lubricating oil composition is at least about 0.1 wt. % on an actives basis, based on the total weight of the lubricating oil composition.

23 Claims, No Drawings

TRUNK PISTON ENGINE LUBRICATING OIL COMPOSITIONS

BACKGROUND OF THE INVENTION

1. Technical Field

The present invention generally relates to trunk piston engine lubricating oil compositions.

2. Description of the Related Art

Trunk piston engines operate using various types and qualities of diesel fuels and heavy fuel oils. These fuels typically contain high concentrations of asphaltenes, generally the heaviest and most polar fraction of petroleum distillate. Asphaltenes are highly complex compounds believed to be composed of polyaromatic sheets containing alkyl side chains, and are generally insoluble in lubricating oils. When heavy fuel oils and conventional lubricant oil compositions mix in different temperature regions of a trunk piston engine, black sludge (such as asphaltene deposits or other deposits) and other asphaltene derived deposits (such as undercrown deposits) tend to form. The formation of black sludge or deposit can adversely affect the service interval and maintenance cost of the trunk piston engine. Therefore, an important performance aspect of these lubricants is residual fuel compatibility.

Presently, there is a move in the industry in different regions of the world to replace Group I basestocks with Group II basestocks in trunk piston engine oils. Group II basestocks generally have a lower aromatic content than Group I basestocks, thereby resulting in a loss of heavy fuel oil (also known as residual fuel oil) compatibility when Group II or higher basestocks are used in trunk piston engine lubricating oils rather than Group I basestocks. It is believed that this loss of heavy fuel oil compatibility is due to the much lower solubility of asphaltenes in the Group II or higher basestocks compared to Group I basestocks. Generally, the problem of the loss of heavy fuel oil compatibility has been typically addressed by increasing the amount of detergent-containing trunk piston engine lubricating oil additive packages.

Several attempts have been made to develop a lubricating oil composition having improved performance within trunk piston engines operating on heavy fuel oils. For example, EP 1154012 discloses a dispersant-free lubricating oil composition comprising an oil of lubricating viscosity, an overbased metal detergent, and an antiwear additive, wherein the composition can contain small amounts of a dispersant provided that the composition does not substantially demonstrate the dispersancy effect of the component.

Similarly, EP 1209218 discloses a dispersant-free lubricating oil composition comprising an oil of lubricating viscosity, an overbased metal detergent, and an antiwear additive, where the composition can contain less than or equal to 1 mass % of a dispersant.

U.S. Patent Application Publication No. 20090093387 ("the '387 application") discloses a lubricating oil composition containing (a) a Group II basestock, and (b) a neutral or overbased metal hydrocarbyl-substituted hydroxybenzoate detergent having a basicity index of less than 2. The '387 application further discloses that the neutral or overbased metal salicylate detergent having a basicity index of less than 2 improves asphaltene dispersancy in Group II basestocks.

Accordingly, it would be desirable to provide an improved trunk piston engine lubricating oil composition which exhibits improved heavy fuel oil compatibility.

SUMMARY OF THE INVENTION

In accordance with one embodiment of the present invention, a trunk piston engine lubricating oil composition is provided comprising (a) a major amount of a basestock selected from the group consisting of at least one Group III basestock, at least one Group IV basestock and mixtures thereof; (b) at least one detergent additive; and (c) at least one dispersant additive; wherein the concentration of the at least one dispersant additive in the trunk piston engine lubricating oil composition is at least about 0.1 wt. % on an actives basis, based on the total weight of the lubricating oil composition.

In accordance with a second embodiment of the present invention, a trunk piston engine lubricating oil composition is provided comprising (a) a major amount of at least one Group III basestock having a paraffinic carbon content of at least about 70% as determined by test method ASTM D 3238-95 (2005); (b) at least one detergent additive; and (c) at least one dispersant additive; wherein the concentration of the at least one dispersant additive in the trunk piston engine lubricating oil composition is at least about 0.1 wt. % on an actives basis, based on the total weight of the lubricating oil composition.

In accordance with a third embodiment of the present invention, there is provided a method for reducing black sludge and deposit formation in a trunk piston engine, comprising lubricating the trunk piston engine with a trunk piston engine lubricating oil composition comprising (a) a major amount of a basestock selected from the group consisting of at least one Group III basestock, at least one Group IV basestock and mixtures thereof; (b) at least one detergent additive; and (c) at least one dispersant additive; wherein the concentration of the at least one dispersant additive in the trunk piston engine lubricating oil composition is at least about 0.1 wt. % on an actives basis, based on the total weight of the lubricating oil composition.

In accordance with a fourth embodiment of the present invention, there is provided a method for operating a trunk piston engine comprising lubricating the trunk piston engine with a trunk piston engine lubricating oil composition is provided comprising (a) a major amount of a basestock selected from the group consisting of at least one Group III basestock, at least one Group IV basestock and mixtures thereof; (b) at least one detergent additive; and (c) at least one dispersant additive; wherein the concentration of the at least one dispersant additive in the trunk piston engine lubricating oil composition is at least about 0.1 wt. % on an actives basis, based on the total weight of the lubricating oil composition.

It has been surprisingly found that the use of at least about 0.1 wt. % on an actives basis of at least one dispersant additive in a trunk piston engine lubricating oil composition containing at least one Group III basestock and/or at least one Group IV basestock decreases deposits due to asphaltene deposition, in particular in trunk piston engine oils based on alkyl-substituted hydroxybenzoate detergent chemistry. The decrease in deposits appears to increase with increasing dispersant concentration even at high dispersant concentrations, in contrast with what has been seen in Group I and II basestocks.

DETAILED DESCRIPTION OF THE PREFERRED EMBODIMENTS

The present invention is directed to a trunk piston engine lubricating oil composition is provided comprising (a) a major amount of a basestock selected from the group consisting of at least one Group III basestock, at least one Group IV basestock and mixtures thereof; (b) at least one detergent additive; and (c) at least one dispersant additive; wherein the concentration of the at least one dispersant additive in the trunk piston engine lubricating oil composition is at least about 0.1 wt. % on an actives basis, based on the total weight of the lubricating oil composition.

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

The term "major amount" as used herein refers to a concentration of the basestock within the lubricating oil composition of at least about 40 wt. %. In one embodiment, the term "major amount" refers to a concentration of the basestock within the lubricating oil composition of at least about 50 wt. %. In another embodiment, the term "major amount" refers to a concentration of the basestock within the lubricating oil composition of at least about 60 wt. %. In yet another embodiment, the term "major amount" refers to a concentration of the basestock within the lubricating oil composition of at least about 70 wt. %. In still yet another embodiment, the term "major amount" refers to a concentration of the basestock within the lubricating oil composition of at least about 80 wt. %. In another embodiment, the term "major amount" refers to a concentration of the basestock within the lubricating oil composition of or at least about 90 wt. %.

The term "on an actives basis" indicates that only the active component(s) of a particular additive are considered when determining the concentration or amount of that particular additive within the overall trunk piston engine lubricating oil composition. Diluents and any other inactive components of the additive, such as diluent oil, are excluded. Unless otherwise indicated, in describing the trunk piston engine lubricating oil composition, concentrations provided herein for the one or more dispersant additives are indicative of the concentration of the dispersant (and not of any inactive components within the dispersant additive, such as diluent oil) within the trunk piston engine lubricating oil composition.

The term "trunk piston engine oils" are oils used to lubricate both the crankcase and the cylinders of a trunk piston engine. The term "trunk piston" refers to the piston skirt or trunk. The trunk piston transmits the thrust caused by connecting-rod angularity to the side of the cylinder liner, in the same way as the crosshead slipper transmits the thrust to the crosshead guide. Trunk piston engines are generally medium speed (about 250 to about 1000 rpm) 4-stroke compression-ignition (diesel) engines. Accordingly, the trunk piston engine lubricating oil compositions, and trunk piston engine oils (TPEO) described herein (collectively "lubricating oil compositions") can be used for lubricating any trunk piston engine or compression-ignited (diesel) marine engine, such as a 4-stroke trunk piston engine or 4-stroke diesel marine engine.

In general, the basestock for use in the trunk piston engine lubricating oil compositions of the present invention contain one or more Group III basestocks and/or one or more Group IV basestocks. A Group III basestock and/or Group IV basestock can be any petroleum derived basestock of lubricating viscosity as defined in API Publication 1509, 14th Edition, 1996 (i.e., API Base Oil Interchangeability Guidelines for Passenger Car Motor Oils and Diesel Engine Oils), which is incorporated herein by reference in its entirety. API guidelines define a basestock as a lubricant component that may be manufactured using a variety of different processes. A Group III basestock generally has a total sulfur content less than or equal to 0.03 wt. % (as determined by ASTM D 2270), a saturates content of greater than or equal to 90 wt. % (as determined by ASTM D 2007), and a viscosity index (VI) of greater than or equal to 120 (as determined by ASTM D 4294, ASTM D 4297 or ASTM D 3120). In one embodiment, the basestock is a Group III basestock, or a blend of two or more different Group III basestocks.

In general, Group III basestocks derived from petroleum oils are severely hydrotreated mineral oils. Hydrotreating involves reacting hydrogen with the basestock to be treated to remove heteroatoms from the hydrocarbon, reduce olefins and aromatics to alkanes and cycloparaffins respectively, and in very severe hydrotreating, open up naphthenic ring structures to non-cyclic normal and iso-alkanes ("paraffins"). In one embodiment, a Group III basestock has a paraffinic carbon content (% $C_p$) of at least about 70%, as determined by test method ASTM D 3238-95 (2005), "Standard Test Method for Calculation of Carbon Distribution and Structural Group Analysis of Petroleum Oils by the n-d-M Method". In another embodiment, a Group III basestock has a paraffinic carbon content (% $C_p$) of at least about 72%. In another embodiment, a Group III basestock has a paraffinic carbon content (% $C_p$) of at least about 75%. In another embodiment, a Group III basestock has a paraffinic carbon content (% $C_p$) of at least about 78%. In another embodiment, a Group III basestock has a paraffinic carbon content (% $C_p$) of at least about 80%. In another embodiment, a Group III basestock has a paraffinic carbon content (% $C_p$) of at least about 85%.

In another embodiment, a Group III basestock has a naphthenic carbon content (% $C_n$) of no more than about 25%, as determined by ASTM D 3238-95 (2005). In another embodiment, a Group III basestock has a naphthenic carbon content (% $C_n$) of no more than about 20%. In another embodiment, a Group III basestock has a naphthenic carbon content (% $C_n$) of no more than about 15%. In another embodiment, a Group III basestock has a naphthenic carbon content (% $C_n$) of no more than about 10%.

Many of the Group III basestocks are available commercially, e.g., Chevron UCBO basestocks; Yukong Yubase basestocks; Shell XHVI® basestocks; and ExxonMobil Exxsyn® basestocks.

In one embodiment, a Group III basestock for use herein is a Fischer-Tropsch derived base oil. The term "Fischer-Tropsch derived" means that the product, fraction, or feed originates from or is produced at some stage by a Fischer-Tropsch process. For example, a Fischer Tropsch base oil can be produced from a process in which the feed is a waxy feed recovered from a Fischer-Tropsch synthesis, see, e.g., U.S. Patent Application Publication Nos. 2004/0159582; 2005/0077208; 2005/0133407; 2005/0133409; 2005/0139513; 2005/0139514; 2005/0241990; 2005/0261145; 2005/0261146; 2005/0261147; 2006/0016721; 2006/0016724; 2006/0076267; 2006/013210; 2006/0201851; 2006/020185, and 2006/0289337; U.S. Pat. Nos. 7,018,525 and 7,083,713 and U.S. application Ser. Nos. 11/400,570, 11/535,165 and 11/613,936, each of which are incorporated herein by reference. In general, the process involves a complete or partial hydroisomerization dewaxing step, employing a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions.

Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, WO-A-9934917; WO-A-9920720; WO-A-05107935; EP-A-776959; EP-A-668342; U.S. Pat. Nos. 4,943,672, 5,059,299, 5,733,839, and RE39073; and U.S. Patent Application Publication No. 2005/

0227866. The Fischer-Tropsch synthesis product can contain hydrocarbons having 1 to about 100 carbon atoms or, in some cases, more than 100 carbon atoms, and typically includes paraffins, olefins and oxygenated products.

In another embodiment, the basestock is at least one Group IV basestock, or polyalphaolefin (PAO). PAOs are typically made by the oligomerization of low molecular weight alpha-olefins, e.g., alpha-olefins containing at least 6 carbon atoms. In one embodiment, the alpha-olefins are alpha-olefins containing 10 carbon atoms. PAOs are mixtures of dimers, trimers, tetramers, etc., with the exact mixture depending upon the viscosity of the final basestock desired. PAOs are typically hydrogenated after oligomerization to remove any remaining unsaturation.

In one embodiment, the basestock for use herein can be a blend or a mixture of two or more, three or more, or even four or more Group III basestocks and/or Group IV basestocks having different molecular weights and viscosities. The blend can be processed in any suitable manner to create a basestock having suitable properties such as, for example, viscosity and TBN values, as discussed hereinbelow, for use in a trunk piston engine.

If desired, the trunk piston engine lubricating oil compositions of the present invention can contain minor amounts of basestocks other than Group III or IV basestocks, such as a Group I basestock and/or a Group II basestock.

The trunk piston engine lubricating oil compositions of the present invention can have any total base number (TBN) that is suitable for use in trunk piston engines. The term "total base number" or "TBN" refers to the amount of base equivalent to milligrams of KOH in 1 gram of sample. Thus, higher TBN numbers reflect more alkaline products and therefore a greater alkalinity reserve. The TBN of the trunk piston engine lubricating oil compositions can be measured by any suitable method, such as by ASTM D2896. In general, a trunk piston engine lubricating oil composition of the present invention can have a TBN of at least about 12. In one embodiment, a trunk piston engine lubricating oil composition of the present invention can have a TBN of about 20 to about 60. In another embodiment, a trunk piston engine lubricating oil composition of the present invention can have a TBN of about 30 to about 50.

The trunk piston engine lubricating oil compositions of the present invention can have any viscosity that is suitable for use in a trunk piston engine. Generally, a trunk piston engine lubricating oil composition of the present invention can have a viscosity ranging from about 5 to about 25 centistokes (cSt) at 100° C. In one embodiment, a trunk piston engine lubricating oil composition of the present invention can have a viscosity ranging from about 10 to about 20 cSt at 100° C. The viscosity of the trunk piston engine lubricating oil composition can be measured by any suitable method, e.g., ASTM D2270.

The trunk piston engine lubricating oil compositions will contain one or more detergents. The detergents can be any overbased or neutral detergents. In one embodiment, the detergent is a salt of an alkyl-substituted hydroxybenzoic acid, such as an overbased alkyl-hydroxybenzoate detergent, e.g., an overbased metal salt of an overbased alkyl-substituted hydroxybenzoic acid detergent, and the like and mixtures thereof. Generally, an overbased detergent is any detergent in which the TBN of the additive has been increased by a process such as the addition of a base source (e.g., lime) and an acidic overbasing compound (e.g., carbon dioxide).

In one embodiment, at least about 75 mole % (e.g., at least about 80 mole %, at least about 85 mole %, at least about 90 mole %, at least about 95 mole %, or at least about 99 mole %) of the alkyl groups contained within the detergent such as the alkyl groups of a salt of an alkyl-substituted hydroxybenzoic acid detergent, or of an alkyl-substituted hydroxybenzoic acid) are a $C_{20}$ or higher. In another embodiment, the detergent is a salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins. If desired, the salt (e.g., an overbased salt) of an alkyl-substituted hydroxybenzoic acid is an alkaline earth salt (e.g., calcium or magnesium) of an alkyl-substituted hydroxybenzoic acid.

In another embodiment, the one or more detergents are an overbased salt (such as an overbased alkaline earth metal salt) of a mixture of alkyl-substituted hydroxybenzoic acid and alkyl-substituted phenol. In another embodiment, the one or more detergents are an overbased salt of an alkyl-substituted hydroxybenzoic acid and/or an overbased salt of an alkyl-substituted phenol, in combination with a non-overbased salt of one or more of: an alkyl-substituted hydroxybenzoic acid and an alkyl-substituted phenol. In another embodiment, the one or more detergents are the one or more detergents are an overbased salt of an alkyl-substituted hydroxybenzoic acid and no other overbased salts (other than the salt of the detergent). The detergent, in this regard, can contain any suitable concentration of anion (e.g., organic anion) associated with the alkylhydroxybenzoate (or salt of the alkyl-substituted hydroxybenzoic acid).

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the detergent such as the alkyl groups of a salt of an alkyl-substituted hydroxybenzoic acid detergent, or of an alkyl-substituted hydroxybenzoic acid) are about $C_{14}$ to about $C_{18}$.

Representative examples of suitable metal detergents include, but are not limited to, sulfurized or unsulfurized alkyl or alkenyl phenates, alkyl or alkenyl aromatic sulfonates, borated sulfonates, sulfurized or unsulfurized metal salts of multi hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and the like and mixtures thereof. Other non-limiting examples of suitable metal detergents include, but are not limited to, metal sulfonates, phenates, salicylates, phosphonates, thiophosphonates and combinations thereof. The metal can be any metal suitable for making sulfonate, phenate, salicylate or phosphonate detergents such as alkali metals, alkaline earth metals and transition metals and the like. Examples of such metals include Ca, Mg, Ba, K, Na, Li and the like. In one embodiment, the metal suitable for making the detergents is an alkaline earth metal such as Ca or Mg. In another embodiment, the metal suitable for making the detergents is Ca.

In one embodiment, the trunk piston engine lubricating oil compositions contain no detergent that does not contain a salt of an alkyl-substituted hydroxybenzoic acid. In one embodiment, the trunk piston engine lubricating oil compositions do not contain a salt of a sulfonic acid. In another embodiment, the trunk piston engine lubricating oil compositions do not contain an alkylphenol detergent not containing a salt of an alkyl-substituted hydroxybenzoic acid. In another embodiment, the trunk piston engine lubricating oil compositions do not contain a salicylate-based detergent. In one embodiment, a detergent of the trunk piston engine lubricating oil compositions does not contain an alkyl phenate.

Generally, the amount of detergent present in the trunk piston engine lubricating oil compositions can range from about 0.1 wt. % to about 35 wt. %, based on the total weight of the trunk piston engine lubricating oil composition. In one embodiment, the amount of detergent present in the trunk piston engine lubricating oil compositions can range from about 0.25 wt. % to about 25 wt. %, based on the total weight of the trunk piston engine lubricating oil composition. In one embodiment, the amount of detergent present in the trunk piston engine lubricating oil compositions can range from about 0.5 wt. % to about 20 wt. %, based on the total weight of the trunk piston engine lubricating oil composition.

The "soap content" of a trunk piston engine lubricating oil composition refers to the concentration of surfactant anion, for example, an alkylhydroxybenzoate anion, that is contributed to the formulation by one or more detergents within the composition. For the purposes of this invention, the surfactant concentration is reported in terms of millimoles surfactant per kg of oil. Soap concentration can be determined by known techniques, e.g., titration, liquid chromatography, dialysis and the like, or as disclosed in U.S. Pat. No. 5,558,802. In one embodiment, the soap content for the trunk piston engine lubricating oil composition of the present invention may be less than about 250 millimoles surfactant/kg trunk piston engine oil composition (mmol/kg). In another embodiment, the soap content for the trunk piston engine lubricating oil composition of the present invention may be less than about 230 mmol/kg. In another embodiment, the soap content for the trunk piston engine lubricating oil composition of the present invention may be less than about 200 mmol/kg. As one skilled in the art will readily appreciate, the soap content may be achieved by means of a single detergent, or by a mixture of detergents.

The trunk piston engine lubricating oil composition will also contain one or more dispersant additives ("dispersant") for use herein, which can be in any suitable form. In one embodiment, a dispersant is mixed or blended in the trunk piston engine lubricating oil composition in the form of a dispersion or suspension using any suitable dispersant and diluent oil (such as any Group I oil, Group II oil, or mixture thereof) in any suitable process. In one embodiment, the diluent oil is an oil that is different from the basestock (e.g., a Group I basestock) of the trunk piston engine lubricating oil composition. In another embodiment, the diluent oil is an oil that is the same as the basestock of the trunk piston engine lubricating oil composition.

The dispersant can be any suitable dispersant or mixture of multiple dispersants. Examples of ashless dispersants include, but are not limited to, polyalkylene succinic anhydrides; non-nitrogen containing derivatives of a polyalkylene succinic anhydride; a basic nitrogen compound selected from the group consisting of succinimides, carboxylic acid amides, hydrocarbyl monoamines, hydrocarbyl polyamines, Mannich bases, phosphonoamides, and phosphoramides; triazoles, e.g., alkyltriazoles and benzotriazoles; copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. The derivatives of these dispersants, e.g., borated dispersants such as borated succinimides, may also be used. These and other suitable dispersants have been described in Mortier et al., "Chemistry and Technology of Lubricants," 2nd Edition, London, Springer, Chapter 3, pages 86-90 (1996); and Leslie R. Rudnick, "Lubricant Additives: Chemistry and Applications," New York, Marcel Dekker, Chapter 5, pages 137-170 (2003), both of which are incorporated herein by reference in their entirety.

In one embodiment, a dispersant is a succinimide or a derivative thereof. In another embodiment, a dispersant is a succinimide or derivative thereof which is obtained by reaction of a polyisobutenyl succinic anhydride (PIBSA) and a polyamine. In another embodiment, a dispersant is a succinimide or derivative thereof which is obtained by reaction of a PIBSA and a polyamine, wherein the PIBSA is produced from polybutene and maleic anhydride (such as by a thermal reaction method using neither chlorine or a chlorine atom-containing compound).

In another embodiment, a dispersant is a succinimide reaction product of the condensation reaction between a PIBSA and one or more alkylene polyamines. The PIBSA, in this embodiment, can be the thermal reaction product of high methylvinylidene polyisobutene (PIB) and maleic anhydride. In one embodiment, a dispersant is a primarily bis-succinimide reaction product derived from a PIB having a number average molecular weight (Mn) of about 500 to about 3000. In one embodiment, a PIB has a Mn of from about 700-2700. In another embodiment, a dispersant is a primarily bis-succinimide reaction product derived from a PIB having a Mn of at least about 600, at least about 800, at least about 1000, at least about 1100, at least about 1200, at least about 1300, at least about 1400, at least about 1500, at least about 1600, at least about 1700, at least about 1800, at least about 1900, at least about 2000, at least about 2100, at least about 2200, at least about 2300, at least about 2400, at least about 2500, at least about 2600, at least about 2700, at least about 2800, at least about 2900, or at least about 3000.

In another embodiment, a dispersant is a primarily bis-succinimide reaction product derived from an about 1000 Mn PIB, and is subsequently borated to achieve a boron concentration of about 0.1 to about 3 wt. % in the succinimide. In another preferred embodiment, a dispersant is a primarily bis-succinimide reaction product derived from an about 1300 Mn PIB, and is subsequently borated to achieve a boron concentration of about 0.1 to about 3 wt. % in the succinimide. In another embodiment, a dispersant is a primarily bis-succinimide reaction product derived from an about 2300 Mn PIB, and is subsequently reacted with ethylene carbonate.

A dispersant can be a succinimide prepared by the reaction of a high molecular weight alkenyl- or alkyl-substituted succinic anhydride and a polyalkylene polyamine having 4 to 10 nitrogen atoms (average value), or 5 to 7 nitrogen atoms (average value) per mole. The alkenyl or alkyl group of the alkenyl or alkyl succinimide compound, in this regard, can be derived from a polybutene having a number average molecular weight of about 900 to 3000. In one embodiment, the reaction between polybutene and maleic anhydride for the preparation of polybutenyl succinic anhydride can be performed by a chlorination process using chlorine. Accordingly, in some embodiments, the resulting polybutenyl succinic anhydride as well as a polybutenyl succinimide produced from the polybutenyl succinic anhydride has a chlorine content in the range of approximately 2,000 to 3,000 ppm (wt). In contrast, a thermal process using no chlorine gives a polybutenyl succinic anhydride and a polybutenyl succinimide having a chlorine content in a range of such as less than 30 ppm (wt). Therefore, a succinimide derived from a succinic anhydride produced by the thermal process is preferred, in some embodiments, due to the smaller chlorine content in the trunk piston engine lubricating oil composition.

In another embodiment, the dispersant comprises a modified alkenyl- or alkyl-succinimide which is after-treated with a compound selected from a boric acid, an alcohol, an aldehyde, a ketone, an alkylphenol, a cyclic carbonate (e.g., ethylene carbonate), an organic acid, a succiamide, a succinate ester, a succinate ester-amide, pentaerythritol, phenate-salicylate and their post-treated analogs and the like, and the combinations thereof. Preferred modified succinimides are borated alkenyl- or alkyl-succinimides, such as alkenyl- or alkyl-succinimides which are after-treated with boric acid or a boron-containing compound. In another embodiment, the dispersant comprises alkenyl- or alkyl-succinimide that has not been after- or post-treated.

The amount of the one or more dispersants present in the trunk piston engine lubricating oil composition is greater than about 0.1 wt. % on an actives basis, e.g., from about 0.1 wt. % to about 5 wt. % on an actives basis, based on the total weight of the lubricating oil composition. In one embodiment, the amount of the one or more dispersants present in the trunk piston engine lubricating oil composition is from about 0.1 wt. % to about 4 wt. % on an actives basis. In one embodiment, the amount of the one or more dispersants present in the trunk piston engine lubricating oil composition is from about 0.1 wt. % to about 3 wt. % on an actives basis. In one embodiment, the amount of the one or more dispersants present in the trunk piston engine lubricating oil composition is from about 0.1 wt. % to about 2 wt. % on an actives basis.

In another embodiment, the amount of the one or more dispersants present in the trunk piston engine lubricating oil composition is greater than about 0.2 wt. % on an actives basis, e.g., from about 0.2 wt. % to about 5 wt. % on an actives basis, based on the total weight of the lubricating oil composition. In one embodiment, the amount of the one or more dispersants present in the trunk piston engine lubricating oil composition is from about 0.2 wt. % to about 4 wt. % on an actives basis. In one embodiment, the amount of the one or more dispersants present in the trunk piston engine lubricating oil composition is from about 0.2 wt. % to about 3 wt. % on an actives basis. In one embodiment, the amount of the one or more dispersants present in the trunk piston engine lubricating oil composition is from about 0.2 wt. % to about 2 wt. % on an actives basis.

In another embodiment, the amount of the one or more dispersants present in the trunk piston engine lubricating oil composition is greater than about 0.3 wt. % on an actives basis, e.g., from about 0.3 wt. % to about 5 wt. % on an actives basis, based on the total weight of the lubricating oil composition. In one embodiment, the amount of the one or more dispersants present in the trunk piston engine lubricating oil composition is from about 0.3 wt. % to about 4 wt. % on an actives basis. In one embodiment, the amount of the one or more dispersants present in the trunk piston engine lubricating oil composition is from about 0.3 wt. % to about 3 wt. % on an actives basis. In one embodiment, the amount of the one or more dispersants present in the trunk piston engine lubricating oil composition is from about 0.3 wt. % to about 2 wt. % on an actives basis.

In another embodiment, the amount of the one or more dispersants present in the trunk piston engine lubricating oil composition is greater than about 0.5 wt. % on an actives basis, e.g., from about 0.5 wt. % to about 5 wt. % on an actives basis, based on the total weight of the lubricating oil composition. In one embodiment, the amount of the one or more dispersants present in the trunk piston engine lubricating oil composition is from about 0.5 wt. % to about 4 wt. % on an actives basis. In one embodiment, the amount of the one or more dispersants present in the trunk piston engine lubricating oil composition is from about 0.5 wt. % to about 3 wt. % on an actives basis. In one embodiment, the amount of the one or more dispersants present in the trunk piston engine lubricating oil composition is from about 0.5 wt. % to about 2 wt. % on an actives basis.

In another embodiment, the amount of the one or more dispersants present in the trunk piston engine lubricating oil composition is greater than about 0.7 wt. % on an actives basis, e.g., from about 0.7 wt. % to about 5 wt. % on an actives basis, based on the total weight of the lubricating oil composition. In one embodiment, the amount of the one or more dispersants present in the trunk piston engine lubricating oil composition is from about 0.7 wt. % to about 4 wt. % on an actives basis. In one embodiment, the amount of the one or more dispersants present in the trunk piston engine lubricating oil composition is from about 0.7 wt. % to about 3 wt. % on an actives basis. In one embodiment, the amount of the one or more dispersants present in the trunk piston engine lubricating oil composition is from about 0.7 wt. % to about 2 wt. % on an actives basis.

In one embodiment, the amount of the one or more dispersants present in the trunk piston engine lubricating oil composition is greater than about 1 wt. % on an actives basis, e.g., from about 1 wt. % to about 5 wt. % on an actives basis, based on the total weight of the lubricating oil composition. In one embodiment, the amount of the one or more dispersants present in the trunk piston engine lubricating oil composition is from about 1 wt. % to about 4 wt. % on an actives basis. In one embodiment, the amount of the one or more dispersants present in the trunk piston engine lubricating oil composition is from about 1 wt. % to about 3 wt. % on an actives basis. In one embodiment, the amount of the one or more dispersants present in the trunk piston engine lubricating oil composition is from about 1 wt. % to about 2 wt. % on an actives basis.

The trunk piston engine lubricating oil compositions of the present invention can be prepared by any method known to a person of ordinary skill in the art for making trunk piston engine lubricating oils. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Rannie homogenizer), a mill (e.g., colloid mill, ball mill or sand mill) or any other mixing or dispersing equipment known in the art.

The trunk piston engine lubricating oil compositions of the present invention may also contain conventional trunk piston engine lubricating oil composition additives for imparting auxiliary functions to give a finished trunk piston engine lubricating oil composition in which these additives are dispersed or dissolved. For example, the trunk piston engine lubricating oil compositions can be blended with antioxidants, anti-wear agents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof. A variety of the additives are known and commercially available. These additives, or their analogous compounds, can be employed for the preparation of the trunk piston engine lubricating oil compositions of the invention by the usual blending procedures. Some suitable additives have been described in Mortier et al., "Chemistry and Technology of Lubricants," 2nd Edition, London, Springer, (1996); and Leslie R. Rudnick, "Lubricant Additives: Chemistry and Applications," New York, Marcel Dekker (2003), both of which are incorporated herein by reference.

Examples of antioxidants include, but are not limited to, aminic types, e.g., diphenylamine, phenyl-alpha-napthylamine, N,N-di(alkylphenyl) amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 Jan. 1992, see, for example, pages 97-100; aryl phosphates and phosphites, sulfur-containing esters, phosphosulfur compounds, metal or ash-free dithiocarbamates, xanthates, alkyl sulfides and the like and mixtures thereof.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof. The amount of the rust inhibitor may vary from about 0.01 wt. % to about 10 wt. %

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof. The amount of the friction modifier may vary from about 0.01 wt. % to about 10 wt. %

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

If desired, the trunk piston engine lubricating oil additives may be provided as an additive package or concentrate in which the additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain one or more of the various additives, referred to above, in the desired amounts and ratios to facilitate direct combination with the requisite amount of the base stock containing at least 90% by weight saturated hydrocarbons and base oil having a viscosity index of less than 70 and at least about 25 wt. % cycloaliphatic hydrocarbon content.

The trunk piston engine lubricating oil compositions of the present invention may be suitable for use in a 4-stroke trunk piston engine having an engine speed of about 200 to about 2,000 rotations per minute (rpm), e.g., about 400 to about 1,000 rpm, and a brake horse-power (BHP) per cylinder of about 50 to about 5,000, preferably about 100 to about 3,000 and most preferably from about 100 to about 2,000. Engines used for auxiliary power generation applications or in land-based power generation applications are also suitable.

The following non-limiting examples are illustrative of the present invention.

The following basestocks were used in the examples:

Group I: Basestock containing a major amount of CORE® 600N basestock available from ExxonMobil.

Group II: Basestock containing a major amount of 600R Group II basestock available from Chevron.

Conventional Group III: Basestock containing a major amount of Yubase 8 basestock available from SK Energy.

GTL Group III: A mixture of two basestocks GTL1 and GTL2 derived from a Fischer-Tropsch process.

Group IV: Basestock containing a major amount of Synfluid® PAO 8 basestock available from Chevron Phillips Chemical Company.

The properties of the basestocks are set forth below in Table 1.

TABLE 1

Basestock Properties

| Property | Test Method | ExxonMobil CORE ® 600N | Chevron 600R | Yubase 8 | GTL 1 | GTL 2 | CPChem Synfluid ® PAO 8 |
|---|---|---|---|---|---|---|---|
| Kinematic Viscosity, cSt @ 40° C. | ASTM D 445 | 119-106 | 104 | 47 | 16.49 | 106.4 | 46 |
| Kinematic Viscosity, cSt @ 100° C. | ASTM D 445 | 12.2 | 12.2 | 7.6 | 4.0 | 16.0 | 7.8 |
| Viscosity Index | ASTM D 2270 | 95 | 107 | 128 | 150 | 161 | 145 |
| Pour Point, ° C. | ASTM D 97 | −6 | −15 | −12 | −25 | −10 | −54 |
| Sulfur, ppm | ASTM D 2622 | 4500 | <15 | <10 | <5 | <5 | 0 |
| Paraffinics, % $C_P$ | ASTM D3238 | 66.3 | 69.2 | 79.4 | 93.9 | 93.0 | NA |
| Naphthenics, % $C_N$ | ASTM D3238 | 28.8 | 30.8 | 20.6 | 6.1 | 7.0 | NA |
| Aromatics, % $C_A$ | ASTM D3238 | 4.9 | 0 | 0 | 0 | 0 | NA |

The following additives are used in the examples:

150 TBN $C_{20+}$ alkyl-substituted hydroxybenzoate: An oil concentrate of an overbased calcium alkylhydroxybenzoate detergent containing 5.35 wt. % Ca and having a TBN of 150, comprising the calcium salt of an alkyl-substituted hydroxybenzoic acid derived from an alkyl-substituted hydroxybenzoic acid wherein at least 90 mole % of the alkyl groups are $C_{20}$ or greater; prepared according to the method described in Example 3 of U.S. Patent Application Publication No. 2007/0027043.

350 TBN $C_{20+}$ alkyl-substituted hydroxybenzoate: An oil concentrate of an overbased calcium alkylhydroxybenzoate detergent containing 12.5 wt. % Ca and having a TBN of 350, comprising the calcium salt of an alkyl-substituted hydroxybenzoic acid derived from an alkyl-substituted hydroxybenzoic acid wherein at least 90 mole % of the alkyl groups are $C_{20}$ or greater; prepared according to the method described in Example 1 of U.S. Patent Application Publication No. 2007/0027043.

170 TBN $C_{14}$ to $C_{18}$ alkyl-substituted hydroxbenzoate: A commercially available, oil concentrate of a low molecular weight overbased calcium alkylhydroxybenzoate detergent, primarily mono-alkylated hydroxybenzoate detergent containing about 6.0 wt. % Ca and having a nominal TBN of 170, comprising a calcium alkylhydroxybenzoate derived from an alkyl-substitued hydroxybenzoic acid wherein at least 95 mole % of the alkyl groups are $C_{14}$ to $C_{18}$.

280 TBN $C_{14}$ to $C_{18}$ alkyl-substituted hydroxbenzoate: A commercially available oil concentrate of a low molecular weight overbased calcium alkylhydroxybenzoate detergent, primarily mono-alkylated hydroxybenzoate detergent containing about 10 wt. % Ca and having a nominal TBN of 280, comprising a calcium alkylhydroxybenzoate derived from an alkyl-substituted hydroxybenzoic acid wherein at least 95 mole % of the alkyl groups are $C_{14}$ to $C_{18}$.

Dispersant: A primarily bissuccinimide dispersant obtained from the reaction of polyisobutenyl succinic anhydride derived from 1000 $M_n$ PIB and an amine mixture of heavy polyamine and diethylenetriamine (DETA).

All trunk piston engine oils (TPEOs) in the following studies were blended to approximately 40 TBN. The Group I and II TPEOs were blended at SAE 40 viscosity grade, while the Group III and IV TPEO were blended at SAE 30 viscosity grade. Both grades are typical for TPEO. Because the Group III and IV basestocks have a much higher viscosity index than the Group I and II basestocks, the different viscosity grades result in viscosities between 2.1 and 2.55 cSt at 200° C., the normal operating temperature of a trunk piston engine.

Residual fuel compatibility was evaluated by means of the black sludge test as described below. All TPEOs exemplified in this study also contained 0.67 wt. % of a secondary zinc dialkyldithiophosphate anti-wear agent, and 0.04 wt. % of a foam inhibitor.

Black Sludge Deposit (BSD) Test

A sample of test oil was mixed with heavy fuel oil to form a test mixture. Each test mixture was pumped over a heated metal test strip, which is controlled at test temperature, for a specified period of time. After cooling and washing, the metal test strips were dried and weighted. The weight of each steel test strip was determined, and the weight of the deposit remaining on the steel test strip was measured and recorded as the change in weight of the steel test strip.

Study of 150 TBN and 350 TBN $C_{20+}$ Detergent-Containing TPEOs Without Dispersant A study was performed to evaluate the performance of traditional alkylhydroxybenzoate-containing TPEO formulations in controlling residual fuel compatibility in the five different base oils. All formulations contained 10.19 wt. % of the 350 TBN $C_{20+}$ detergent and 117 wt. % of the 150 TBN $C_{20+}$ detergent. The results are set forth below in Table 2:

TABLE 2

| Basestock Type | BSD, mg deposit |
|---|---|
| Group I | 14 |
| Group II | 83 |
| Conventional Group III | 235 |

TABLE 2-continued

| Basestock Type | BSD, mg deposit |
|---|---|
| GTL Group III | 412 |
| Group IV, run 1 | 102 |
| Group IV, run 2 | 129 |

As the data show, the Group III and Group IV stocks are more severe than the Group III and IV basestocks. The Group III basestocks in particular appeared to be especially severe.

Study of Soap Content

A study was also made as to the impact of different soap contents in Group III and IV basestocks. The "soap" content of a lubricating oil composition refers to the concentration of surfactant that is contributed to the formulation by one or more detergents within the composition. In traditional Group I and II formulating approaches increasing the amount of surfactant soap improves residual fuel compatibility. The results for the Group III and IV basestocks are set forth below in Table 3.

TABLE 3

| Basestock Type | 350 TBN $C_{20+}$, wt. % | 150 TBN $C_{20+}$, wt. % | Soap content, Mm/kg | BSD, mg deposit |
|---|---|---|---|---|
| GTL Group III | 10.19 | 3.17 | 98 | 412 |
| GTL Group III | 8.00 | 7.92 | 130 | 279 |
| GTL Group III | 5.82 | 12.68 | 163 | 390 |
| GTL Group III | 3.64 | 17.43 | 195 | 132 |
| Group IV, run 1 | 10.19 | 3.17 | 98 | 102 |
| Group IV, run 2 | 10.19 | 3.17 | 98 | 129 |
| Group IV | 8.00 | 7.92 | 130 | 80 |
| Group IV | 5.82 | 12.68 | 163 | 267 |
| Group IV | 3.64 | 17.43 | 195 | 145 |

As the data, it would appear that increasing the soap content has little if any effect on the residual fuel compatibility of Group III and IV basestocks, in contrast to what is seen with Group I basestocks.

Study of Dispersant Concentration

A study was made into the effects of adding a dispersant to a Group II and Group IV TPEO containing alkylhydroxybenzoate detergent formulations such as those shown in Table 2 above. The results of this study are set forth below in Table 4.

TABLE 4

| Base Oil Type | 350 TBN $C_{20+}$, wt. % | 150 TBN $C_{20+}$, wt. % | Dispersant, Active basis wt. % | BSD, mg deposit |
|---|---|---|---|---|
| Conventional Group III | 10.19 | 3.17 | 0 | 235 |
| Conventional Group III | 10.19 | 3.17 | 0.33 | 88 |
| Conventional Group III | 10.19 | 3.17 | 0.67 | 69 |
| Conventional Group III | 10.19 | 3.17 | 1.34 | 23 |
| GTL Group III | 10.19 | 3.17 | 0 | 412 |
| GTL Group III | 10.19 | 3.17 | 0.33 | 65 |
| GTL Group III | 10.19 | 3.17 | 0.67 | 37 |
| GTL Group III | 10.19 | 3.17 | 1.34 | 13 |
| Group IV, run 1 | 10.19 | 3.17 | 0 | 129 |
| Group IV, run 1 | 10.19 | 3.17 | 0.33 | 91 |
| Group IV, run 1 | 10.19 | 3.17 | 0.67 | 69 |
| Group IV, run 1 | 10.19 | 3.17 | 1.34 | 66 |
| Group IV, run 2 | 3.64 | 17.43 | 0 | 145 |
| Group IV, run 2 | 3.64 | 17.43 | 0.33 | 73 |

TABLE 4-continued

| Base Oil Type | 350 TBN $C_{20+}$, wt. % | 150 TBN $C_{20+}$, wt. % | Dispersant, Active basis wt. % | BSD, mg deposit |
|---|---|---|---|---|
| Group IV, run 2 | 3.64 | 17.43 | 0.67 | 17 |
| Group IV, run 2 | 3.64 | 17.43 | 1.34 | 5 |

As the data show, the addition of a dispersant to the Group III and IV TPEOs significantly improves the residual fuel compatibility. It is also seen that this effect exists for both low and high soap formulations. Thus, the dispersant could be used to replace much if not most of the expensive detergent surfactant in a Group III and IV TPEO. Further, the addition of over 1 wt. % actives of a dispersant improves compatibility to the same levels as seen with Group I basestocks.

Study of 170 TBN and 280 TBN $C_{14}$ to $C_{18}$ Detergent-Containing TPEOs

A study similar to the one above was also conducted with conventional TPEO formulations containing $C_{14}$ to $C_{18}$ alkyl-substituted hydroxybenzoate detergents. The results are set forth below in Table 5. It was found that Group III and IV TPEOs not containing a dispersant were also very severe with respect to residual fuel compatibility, and that the addition of small amounts of dispersant greatly improved compatibility.

TABLE 5

| Base Oil Type | 170 TBN $C_{14}$ to $C_{18}$, wt. % | 280 TBN $C_{14}$ to $C_{18}$, wt. % | Dispersant, Active basis wt. % | BSD, mg deposit |
|---|---|---|---|---|
| Conventional Group III | 2.98 | 12.50 | 0 | 330 |
| Conventional Group III | 2.98 | 12.50 | 0.33 | 175 |
| Conventional Group III | 2.98 | 12.50 | 0.67 | 117 |
| Conventional Group III | 2.98 | 12.50 | 1.34 | 27 |
| Group IV | 2.98 | 12.50 | 0 | 190 |
| Group IV | 2.98 | 12.50 | 0.33 | 119 |
| Group IV | 2.98 | 12.50 | 0.67 | 84 |
| Group IV | 2.98 | 12.50 | 1.34 | 22 |

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A trunk piston engine lubricating oil composition comprising:

(a) a major amount of a basestock selected from the group consisting of at least one Group III basestock, at least one Group IV basestock and mixtures thereof;

(b) at least one detergent additive; and (c) at least one dispersant additive selected from the group consisting of a polyalkylene bissuccinimide and a polyalkylene succinimide, wherein the polyalkylene group is a polyisobutenyl group having an average molecular weight of from about 700 to about 2300;

wherein the concentration of the at least one dispersant additive in the trunk piston engine lubricating oil composition is at least about 0.1 wt. % on an actives basis, based on the total weight of the lubricating oil composition;

wherein the trunk piston engine lubricating oil composition has a total base number of at least about 12;

wherein the at least one detergent additive comprises at least one salt of an alkyl-substituted hydroxybenzoic acid; and wherein the trunk piston engine lubricating, oil composition has a soap content of less than about 250 mm/kg.

2. The trunk piston engine lubricating oil composition of claim 1, wherein the basestock is at least one Group III basestock.

3. The trunk piston engine lubricating oil composition of claim 1, wherein the basestock is at least one Group III basestock having a paraffinic carbon content of at least about 70% as determined by test method ASTM D 3238-95(2005).

4. The trunk piston engine lubricating oil composition of claim 2, wherein the at least one Group III basestock comprises at least one Fischer-Tropsch derived basestock.

5. The trunk piston engine lubricating oil composition of claim 1, wherein the basestock comprises at least one Group IV basestock.

6. The trunk piston engine lubricating oil composition of claim 1, wherein, in the at least one salt of an alkyl-substituted hydroxybenzoic acid, at least 75 mole % of the alkyl groups are $C_{20}$ or greater.

7. The trunk piston engine lubricating oil composition of claim 1, wherein, in the at least one salt of an alkyl-substituted hydroxybenzoic acid, at least 50 mole % of the alkyl groups are $C_{14}$ to $C_{18}$.

8. The trunk piston engine lubricating oil composition of claim 1, wherein the at least one dispersant additive comprises a polyalkylene bissuccinimide.

9. The trunk piston engine lubricating oil composition of claim 1, wherein the concentration of the at least one dispersant additive in the trunk piston engine lubricating oil composition is at least about 1 wt. % on an actives basis, based on the total weight of the lubricating oil composition.

10. The trunk piston engine lubricating oil composition of claim 1, wherein the trunk piston engine lubricating, oil composition has a soap content of less than about 200 mm/kg.

11. The trunk piston engine lubricating oil composition of claim 1, further comprising one or more trunk piston engine lubricating oil composition additives selected from the group consisting of an antioxidant, anti-wear agent, rust inhibitor, dehazing agent, demulsifying agent, metal deactivating agent, friction modifier, pour point depressant, antifoaming agent, co-solvent, package compatibiliser, corrosion-inhibitor, dye, extreme pressure agent and mixtures thereof.

12. A method for reducing black sludge and deposit formation in a trunk piston engine, the method comprising lubricating the trunk piston engine with a trunk piston engine lubricating oil composition comprising:

(a) a major amount of a basestock selected from the group consisting of at least one Group III basestock, at least one Group IV basestock and mixtures thereof;

(b) at least one detergent additive; and (c) at least one dispersant additive selected from the group consisting of a polyalkylene bissuccinimide and a polyalkylene succinimide, wherein the polyalkylene group is a polyisobutenyl group having an average molecular weight of from about 700 to about 2300;

wherein the concentration of the at least one dispersant additive in the trunk piston engine lubricating oil composition is at least about 0.1 wt. % on an actives basis, based on the total weight of the lubricating oil composition;

wherein the trunk piston engine lubricating oil composition has a total base number of at least about 12;

wherein the at least one detergent additive comprises at least one salt of an alkyl-substituted hydroxybenzoic acid; and wherein the trunk piston engine lubricating oil composition has a soap content of less than about 250 mm/kg.

13. The method of claim 12, wherein, the basestock is at least one Group III basestock.

14. The method of claim 12, wherein the basestock is at least one Group III basestock having a paraffinic carbon content of at least about 70% as determined by test method ASTM D 3238-95 (2005).

15. The method of claim 13, wherein the at least one Group III basestock comprises at least one Fischer-Tropsch derived basestock.

16. The method of claim 12, wherein the basestock comprises at least one Group IV basestock.

17. The method of claim 12, wherein, in the at least one salt of an alkyl-substituted hydroxybenzoic acid, at least 75 mole of the alkyl groups are $C_{20}$or greater.

18. The method of claim 12, wherein, in the at least one salt of an alkyl-substituted hydroxybenzoic acid, at least 50 mole % of the alkyl groups are $C_{14}$-$C_{18}$.

19. The method of claim 12 wherein the at least one dispersant additive comprises a polyalkylene bissuccinimide.

20. The method of claim 12, wherein the concentration of the at least one dispersant additive in the trunk piston engine lubricating oil composition is at least about 1 wt. % on an actives basis, based on the total weight of the lubricating oil composition.

21. The method of claim 12, wherein the trunk piston engine lubricating oil composition contains a soap content floss than about 200 mm/kg.

22. The trunk piston engine lubricating oil composition of claim 1, wherein the least one dispersant additive comprises a polyalkylene succinimide.

23. The method of claim 12, wherein the at least one dispersant additive comprises a polyalkylene succinimide.

* * * * *